United States Patent [19]

Reiniche

[11] Patent Number: 5,032,191

[45] Date of Patent: Jul. 16, 1991

[54] METHODS AND DEVICES FOR OBTAINING A HOMOGENEOUS AUSTENITE STRUCTURE

[75] Inventor: Andre Reiniche, Clermont-Ferrand, France

[73] Assignee: Compagnie Generale des Etablissements Michelin-Michelin et Cie, Clermont-Ferrand, France

[21] Appl. No.: 365,928

[22] Filed: Jun. 12, 1989

[30] Foreign Application Priority Data

Jun. 21, 1988 [FR] France ..... 88 08425

[51] Int. Cl.[5] ..... C21D 9/63

[52] U.S. Cl. ..... 148/16; 148/128; 148/16.5; 148/154; 148/156; 266/104; 266/110

[58] Field of Search ..... 148/16, 128, 16.5, 154, 148/156, 320, 12 B; 266/104, 108, 110, 111

[56] References Cited

U.S. PATENT DOCUMENTS 3,900,347 8/1975 Lorenzetti et al. ..... 148/12 B
4,759,806 7/1988 Dambre ..... 148/320

*Primary Examiner*—Deborah Yee
*Attorney, Agent, or Firm*—Brumbaugh, Graves, Donohue & Raymond

[57] ABSTRACT

A method and device for thermally treating at least one carbon steel wire in such a way as to obtain a homogenous austenite structure, characterized by the fact that the wire is heated in a tube containing a gas which has practically no forced ventilation, the gas being directly in contact with the wire and the time of heating of the wire being less than 4 seconds per millimeter of diameter of the wire. Pearlitization installation using such a method and device.

24 Claims, 5 Drawing Sheets

X'
X
F
1
2
3
4
5
6
7
8
9
10
11
12
13
14
15
16
17
18
19
20
21
90
100

$D_{te}$
$D_{ti}$
$D_f$
1
2
3
4
6
7
9
10
100

METHODS AND DEVICES FOR OBTAINING A HOMOGENEOUS AUSTENITE STRUCTURE

BACKGROUND OF THE INVENTION

The present invention concerns methods and devices for heat treating carbon steel wires to obtain a homogeneous austenite structure and, if desired, of subjecting these wires to a subsequent thermal treatment to obtain a fine pearlitic structure.

The known methods of austenitization of travelling steel wires are in particular as follows:

heating by induction, in which the wire is subjected to a magnetic field having a frequency of 5,000 to 200,000 Hz; this method is applied under good conditions only to wires of a diameter larger than 3 mm and at temperatures lower than the Curie point.

heating in a muffle furnace by means of electric resistors; this method avoids the inconveniences of heating by induction, but it requires important heating times on the order of 10 to 15 seconds per millimeter of diameter of the wire to achieve the desired result.

heating in a gas furnace; this method also requires important heating times on the same order as those of the muffle furnace since the temperature of the gases at the outlet of the oven must be low if it is desired to obtain a suitable thermal yield; on the other hand, the thermal conductivity of the combustion gases is not as good as that of the gases which can be used in a muffle furnace (hydrogen, mixture of hydrogen and nitrogen, helium); it is possible in gas furnaces to control the deoxidizing power of the combustion gases, but this requires very careful supervision of the adjustment of the gas burners.

SUMMARY OF THE INVENTION

The object of the present invention is to achieve the desired austenitization treatment with heating times of less than 4 seconds per millimeter of diameter of the wire, which makes it possible to have higher rates of production than with the known installations, and which also makes it possible to decrease the lengths of the installations.

Accordingly, the method of the present invention for the heat treatment of at least one carbon steel wire, so as to obtain a homogeneous austenite structure is characterized by the following features:

a) the wire is heated by passing it through at least one tube containing a gas which is practically without forced ventilation, the gas being directly in contact with the wire, the wire heating time being less than 4 seconds per millimeter of diameter of the wire;

b) the characteristics of the tube, the wire and the gas are so selected that the following relationships are satisfied:

$$1.05 \leqq R \leqq 7 \quad (1)$$

$$0.6 \leqq K \leqq 8 \quad (2)$$

with, by definition $$R = D_{ti}/D_f$$

$$K = [Log(D_{ti}/D_f)] \times D_f^2/\lambda$$

$D_{ti}$ being the inside diameter of the tube expressed in millimeters, $D_f$ being the diameter of the wire expressed in millimeters, $\lambda$ being the conductivity of the gas determined at 800° C., this conductivity being expressed in watts.m $^{-1}$.°k$^{-1}$, Log being the natural logarithm.

The invention also concerns a device which makes it possible to heat treat at least one carbon steel wire so as to obtain a homogeneous austenite structure, the device being characterized by the following features:

a) it comprises at least one tube and means making it possible to pass the wire through the tube; the tube contains a gas which is practically without forced ventilation, the gas being directly in contact with the wire, the device comprising means for heating the gas; the means which make it possible to pass the wire through the tube are such that the time of contact of the wire with the gas is less than 4 seconds per millimeter of diameter of the wire;

b) the characteristics of the tube, the wire and gas are so selected that relationships (1) and (2) above are satisfied, $D_{ti}$, $D_f$, $\lambda$ and Log having the same meanings as indicated above.

The expression "practically without forced ventilation" means that the gas in the tube is either stationary or subjected to low ventilation which does not substantially modify the heat exchanges between the wire and the gas, this low ventilation being, for instance, due solely to the displacement of the wire itself.

The invention also concerns the methods and complete installations for the heat treatment of carbon steel wires employing the methods and/or devices previously described.

DESCRIPTION OF THE DRAWINGS

The invention also concerns the steel wires in accordance with the methods and/or with the devices and installations in accordance with the invention.

The invention will be easily understood by means of the nonlimitative examples which follow and the diagrammatic figures relating to these examples.

In the drawings:

FIG. 1 shows a device in accordance with the invention, this figure being a section taken through the axis of the device;

FIG. 2 is a sectional view of the device shown in FIG. 1, this section being taken perpendicular to the axis of the device and being represented by the straight line segments 2—2 in FIG. 1;

FIG. 3 shows in section another device according to the invention, this section being taken along the axis of the device;

FIG. 4 is a sectional view of the device shown in FIG. 3, this section, which is taken perpendicular to the axis of the device, being represented by the straight line segments 4—4 in FIG. 3;

FIG. 5 shows schematically a complete installation for the heat treatment of a metal wire, this installation comprising a device in accordance with the invention;

FIG. 6 is a curve showing the change in the temperature as a function of the time for the wire treated in the installation of FIG. 5;

FIG. 7 shows a device used in the installation of FIG. 5, this figure being a section taken along the axis of the device;

FIG. 8 shows the device of FIG. 7 along a section perpendicular to the axis of the device, this section being indicated by the straight line segments 8—8 in FIG. 7

FIG. 9 shows in section a portion of the fine pearlitic structure of the wire treated in the installation shown in FIG. 5

DESCRIPTION OF PREFERRED EMBODIMENTS

Figure 1:
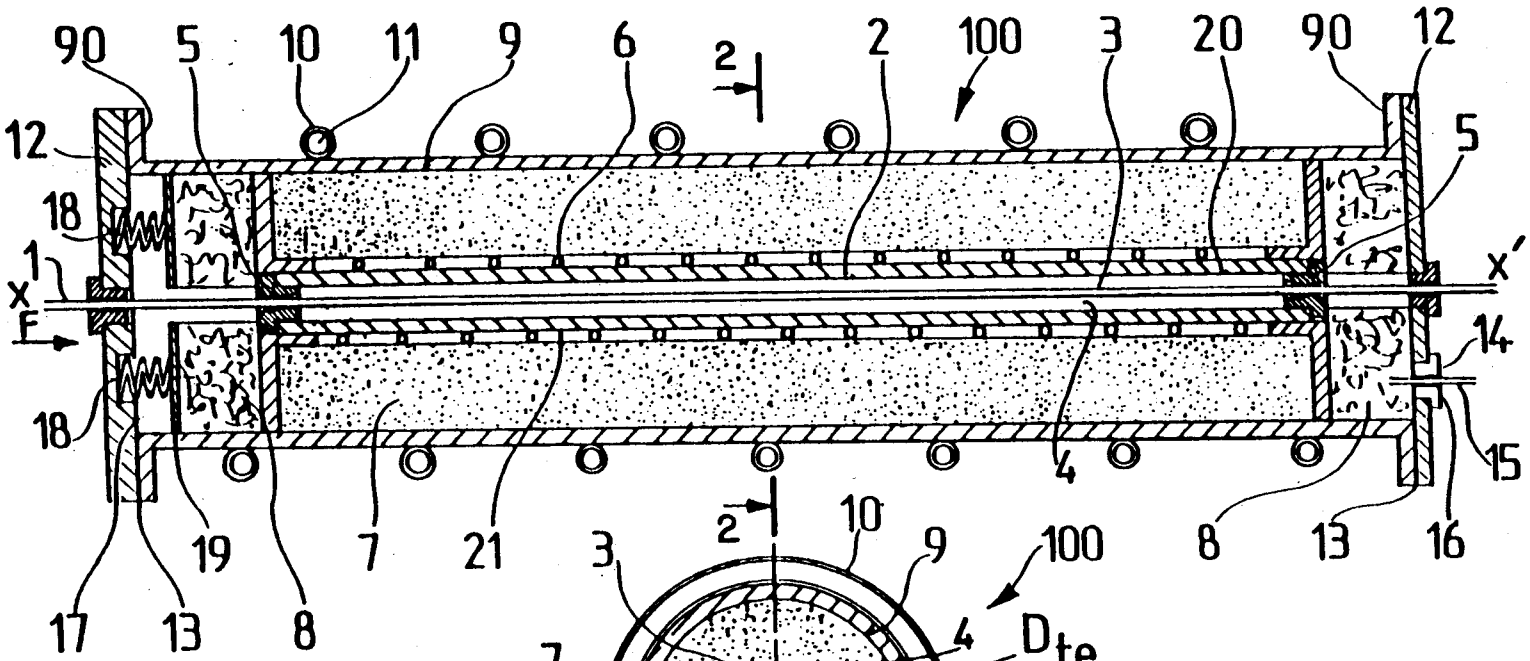
Figure 2:
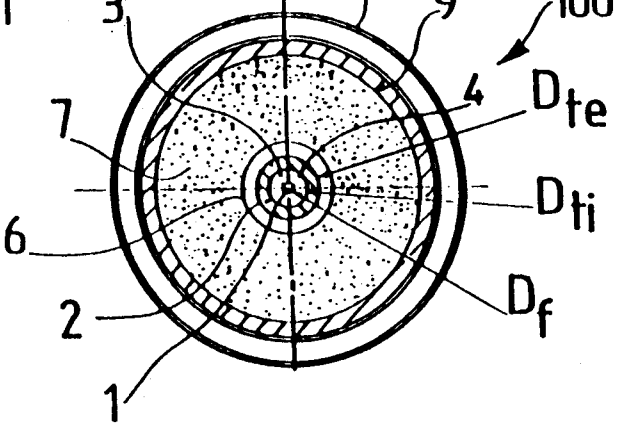

FIGS. 1 and 2 show a device 100 according to the invention for the carrying out of the method of the invention. FIG. 1 is a section through the device 100 along the axis xx' of the device; FIG. 2 is a section perpendicular to this axis xx', the section of FIG. 2 being indicated diagrammatically by the straight line segments II—II in FIG. 1. The device 100 has a tube 2, for instance of ceramic, refractory steel or tungsten carbide, through which the wire 1 of carbon steel passes in the direction indicated by the arrow F along the axis xx'.

The means for the driving of the wire 1 are known means, not shown in FIGS. 1 and 2 for purposes of simplification, these means comprising, for instance, a winder actuated by a motor in order to wind the wire up after treatment.

The space 3 between the wire 1 and the inner wall 20 of the tube 2 is filled by a gas 4. This gas 4 is directly in contact with the wire 1 and the inner wall 20. The gas 4 remains in the space 3 during the treatment of the wire 1, the device 100 being without means capable of permitting forced ventilation of the gas 4, that is to say, the gas 4, which is without forced ventilation, is possibly placed in movement in the space 3 only by the displacement of the wire 1 in the direction indicated by the arrow F. This gas is, for instance, hydrogen, a mixture of hydrogen and nitrogen, a mixture of hydrogen and methane, a mixture of hydrogen, nitrogen and methane, helium, or a mixture of helium and methane.

The wire 1 is guided by two wire guides 5, for instance of ceramic or tungsten carbide, located at the entrance and exit of the wire 1 in the tube 2. The tube 2 is heated on the outside by an electric resistor 6 wound around the tube 2 on the outside of this tube 2 against the outer wall 21 of the tube 2. The tube 2 is heat insulated from the outside by the sleeve 7 surrounding the tube 2 and by the two plates 8 located at the ends of the tube 2. The tube 2 is also electrically insulated, in the event that it is metallic. The plates 8 and the sleeve 7 are, for instance, made of fritted refractory fibers. The tube 2, the heating resistor 6, the sleeve 7 and the plates 8 are placed within a metal tube 9, which is cooled by a hollow tube 10 wound around the tube 9, said hollow tube 10 being traversed by a cooling fluid 11, for instance water.

The device 100 is closed at its two ends by circular plates 12 which rest against the flanges 90 of the tube 9 through gas-tight joints 13. The electric supply to the resistor 6 is through a gas-tight passage 14 through which pass two electric wires 15, each connected to one end of the resistor 6 (this connection has not been shown in the drawing for purposes of simplification). This gas-tight passage 14 is formed in a plug having gas-tight joints 16 and inserted in one of the two circular plates 12.

The device 100 has an expansion play 17, the springs 18, which act on the plate 19, serving for the distribution of the forces, which makes it possible to maintain the tube 2 in the middle of the sleeve 7, whatever its temperature.

In FIG. 2, $D_f$ represents the diameter of the wire 1, $D_{ti}$ represents the inside diameter of the tube 2 (diameter of the inner wall 20), $D_{te}$ represents the outside diameter of the tube 2 (diameter of the outer wall 21). $\lambda$ is the conductivity of the gas 4 determined at 800° C., this conductivity being expressed in watts.m$^{-1}$.°K$^{-1}$.

In accordance with the invention, $D_{ti}$, $D_f$, and $\lambda$ are selected so as to satisfy the following relationships:

$$1.05 \leqq R \leqq 7 \quad (1)$$

$$0.6 \leqq K \leqq 8 \quad (2)$$

with, by definition $$R = D_{ti}/D_f$$

$$K = [Log(D_{ti}/D_f)] \times D_f^2/\lambda$$

$D_{ti}$ and $D_f$ being expressed in millimeters and Log being the natural logarithm.

The invention thus unexpectedly makes it possible to heat the wire 1 from a temperature below the AC3 transformation temperature, for instance from ambient temperature up to a temperature above the AC3 transformation temperature so as to obtain a homogenous austenite structure, and this for a very short period of time of less than 4 seconds per millimeter of diameter of the wire $D_f$. Furthermore, if desired, the nature of the gas 4 can be so selected that it exerts a chemical action on the surface of the wire, for instance a deoxidizing, carburizing, or decarburizing action.

The invention therefore has the following advantages:

simplicity, low investment and operating expenses since no compressors or turbines are used as would be necessary with a forced gas circulation;

a precise heating law can be obtained;

the heating is rapid, which makes it possible to increase the rates of manufacture and to decrease the length of the installation;

the rapid heating can be applied to wires, the diameter $D_f$ of which varies within wide limits, the same device making it possible, in particular, to treat wires having diameters $D_f$ which vary in a ratio of 1 to 5. For wires of large diameter $D_f$, more than 4 mm, the ratio R is close to 1 and the use of a gas which is a very good conductor of heat, for instance hydrogen, then becomes necessary.

The diameter $D_f$ of the wire is preferably at least equal to 0.4 mm and at most equal to 6 mm.

Figure 3:
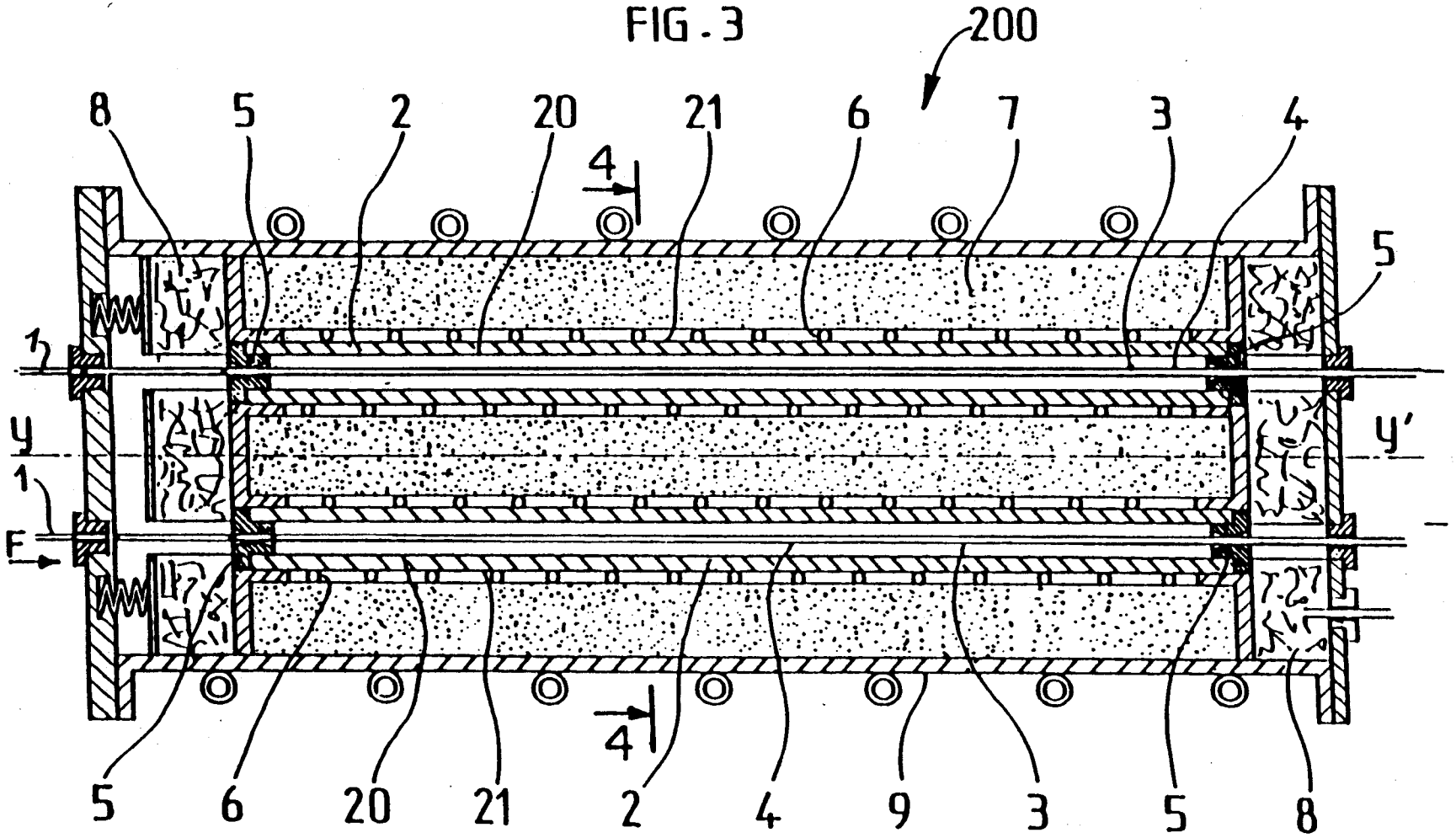
Figure 4:
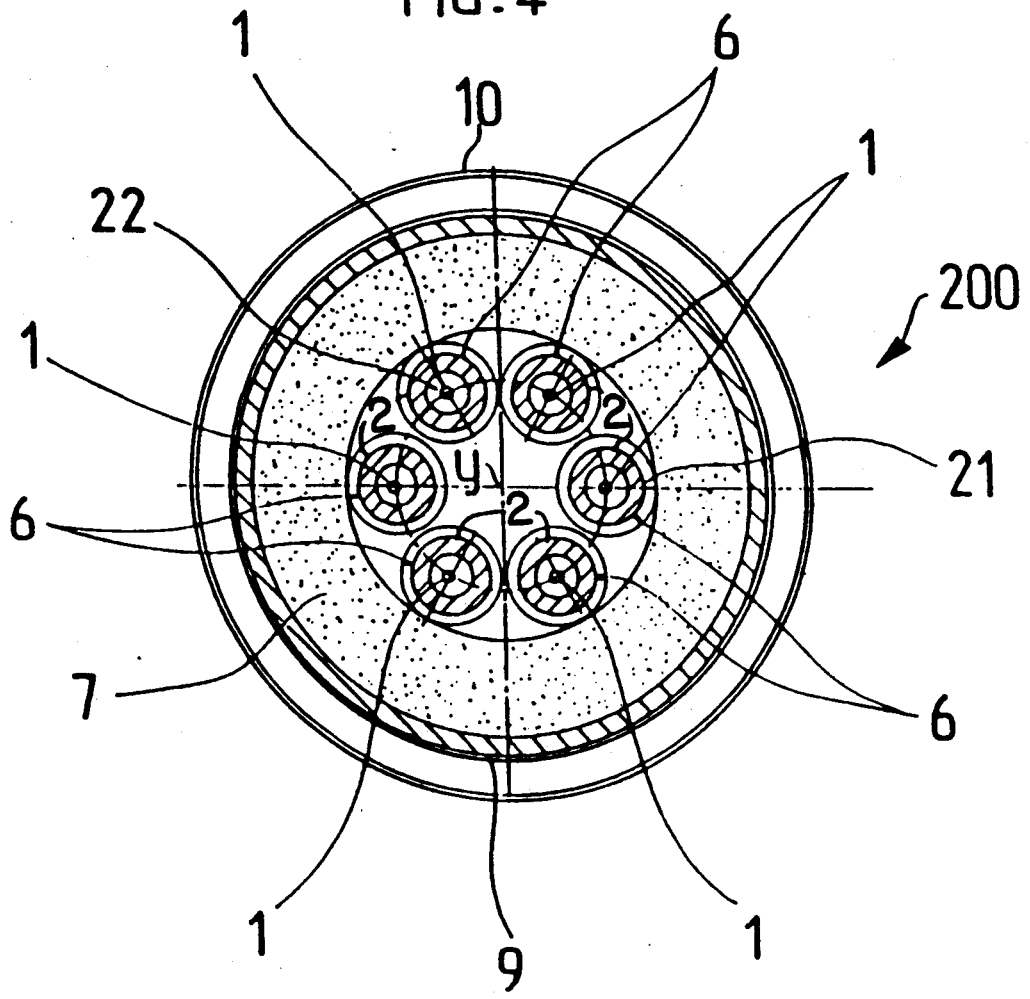

FIGS. 3 and 4 show another device 200 in accordance with the invention, this device making it possible to treat several wires 1, for instance 6, simultaneously, FIG. 3 being a section through this device along the axis yy' of this device and FIG. 4 being a section perpendicular to the axis of this device, the axis yy' being represented by the reference letter "y" in FIG. 4.

The structure of this device 200 is similar to that of the device 100, with the difference that six tubes 2 are arranged in the enclosure 9 formed by a steel tube around the axis yy', which is the axis of this tube 9. A wire 1 passes through each tube 2, the gas 4 being arranged within the tubes 2 each of which is heated by a resistor 6, as previously described in the case of the device 100, the insulating sleeve 7 being arranged around the six tubes 2.

The following examples will make it possible better to understand the invention.

EXAMPLES 1 to 4

Four examples of the treatment of a carbon steel wire 1 with the device 100 previously described will be given. The characteristics of the wire 1 and of the device 100 are given in the following Table 1.

TABLE 1

| | Example No. | | | |
|---|---|---|---|---|
| | 1 | 2 | 3 | 4 |
| Properties of Wire 1 | | | | |
| Carbon content of the steel (% by weight) | 0.70 | 0.85 | 0.75 | 0.80 |
| $D_f$ (mm) | 0.53 | 1.75 | 1.75 | 5.50 |
| Properties of the Device 100 | | | | |
| Nature of the tube 2 | alumina | alumina | alumina | refractory steel |
| $D_{ti}$ (mm) | 1.5 | 2.5 | 3 | 6 |
| $D_{te}$ (mm) | 5 | 6 | 6 | 12 |
| Power of the resistor 6 (kw) | 3.6 | 27 | 20 | 110 |
| Temperature of the outer face 21 of the tube 2 (°C.): | 1100 | 1100 | 1100 | 1100 |
| Speed of travel of the wire 1 (meters per second) | 2.9 | 2.02 | 1.52 | 0.81 |
| Length of the tube 2 (meters) | 2 | 6 | 6 | 5 |
| Heating time $T_c$ (seconds) | 0.69 | 2.97 | 3.96 | 6.15 |
| Production of the device (kilograms of wire 1/hour | 17.9 | 136 | 102 | 540 |
| Temperature of the wire 1 at the entrance to the tube 2 (C.°) | 20 | 20 | 20 | 20 |
| Temperature of the wire 1 at the outlet of the tube 2 (°C.) | 980 | 980 | 980 | 980 |
| λ (watts · $m^{-1}$ · °$K.^{-1}$) | 0.328 | 0.328 | 0.328 | 0.345 |
| R | 2.83 | 1.43 | 1.71 | 1.09 |
| K | 0.89 | 3.33 | 5.03 | 7.63 |
| Heating time per millimeter of diameter of wire 1 (seconds/mm) ($T_c/D_f$) | 1.30 | 1.70 | 2.26 | 1.12 |

The nature of the gas 4 was the following for the examples:

Examples 1, 2, 3: cracked ammonia (75% hydrogen, 25% nitrogen, these percentages being expressed by volume)

Example 4: 78% hydrogen, 2% methane (percent by volume)

The heating time $T_c$ corresponds to the time necessary for the wire to pass from the ambient temperature (about 20° C.) which it had at the entrance of the tube to the temperature which it has at the outlet of the tube (980° C.), this temperature being sufficient to place the carbides in solution.

EXAMPLE 5

In this example, the diameter $D_f$ of the wire 1 is varied, as is the nature of the gas 4, which is a mixture of hydrogen and nitrogen, and therefore the values of λ, R and K are changed. The properties of the wire 1 and of the device 100 are as follows: carbon content of the steel of the wire 1 =0.85%; tube 2 of alumina, $D_{ti}$=2.5 mm, $D_{te}$=6mm; the outer face 21 of the tube 2 is heated to 1100° C. with an electric resistor 6 having a power of 33 kw; speed of travel of the wire 1: 2.35 meters per second; length of the tube 2: 6 meters; heating time: 2.55 seconds; temperature of the wire 1 at the entrance to the tube 2: 20° C., at the outlet from the tube 2: 980° C.

The following Table 2 gives the values of $D_f$, the volumetric percent of the gas 4 of hydrogen, the values of λ, R and K, as well as the production of wire 1. For all the tests corresponding to this example, the heating time per millimeter of diameter of wire ($T_c/D_f$) varies from 1.46 to 3.1 sec/mm.

TABLE 2

| Diameter of the wire 1 (mm) ($D_f$) | R | % $H_2$ | λ at 800° C. (w.$m^{-1}$ · °$K.^{-1}$) | K | Production of wire 1 in kg/hr |
|---|---|---|---|---|---|
| 1.75 | 1.43 | 100 | 0.487 | 2.24 | 158.0 |
| 1.55 | 1.61 | 98 | 0.472 | 2.43 | 124.0 |
| 1.30 | 1.92 | 90 | 0.418 | 2.64 | 87.0 |
| 0.94 | 2.66 | 69 | 0.297 | 2.91 | 45.8 |
| 0.82 | 3.05 | 62 | 0.263 | 2.85 | 35.0 |

EXAMPLE 6

A multi-tube device similar to the device 200 previously described is used, but this time having ten tubes 2. The properties of the example are as follows:

Carbon content of the steel of the wire 1: 0.70%; diameter $D_f$ of the wire: 1.75 mm; identical tubes 2 of alumina, $D_{ti}$=2.5 mm, $D_{te}$=6 mm; the outer faces 21 of the tubes are heated to 1100° C. by means of 10 resistors 6 (one resistor per tube 2), each resistor having a unit power of 27kw (total power 270 kw); gas 4: cracked ammonia; speed of travel of the wire: 2.02 meters per second; length of each tube 2: 6 meters; heating time 2.97 seconds; production of wire 1: 1360 kg/hour; temperature of the wire at the entrance to each tube 2: 20° C., at the outlet from each tube 2: 980° C.; λ=0.328; R=1.43; K=3.33. The heating time per millimeter of diameter of the wire ($T_c/D_f$) is equal to 1.70 sec/mm.

EXAMPLE 7

This example is carried out under the same conditions and with the same results as Example 2, but replacing the cracked ammonia, by a gas 4 which maintains the thermodynamic equilibrium with the carbon of the steel at 800° C., this gas 4 having the following composition (% by volume): 74% hydrogen, 24% nitrogen; 2% methane.

EXAMPLE 8

This example is carried out under the same conditions as Example 2, but the cracked ammonia is replaced by a carburizing gas which makes it possible to correct a decarburization which took place in the preceding operations. The composition of the gas 4 is as follows in this example (% by volume): 85% hydrogen, 15% methane. The other conditions and results are the same as in Example 2, with the following differences: The heating time changes from 2.97 to 2.75 seconds, the ratio $T_c/D_f$ being then equal to 1.57 sec/mm, the speed of travel of the wire is 2.18 m/sec, and a surface recarburization thickness on the order of 2μm is obtained. No deposit of graphite is observed on the wire 1.

The invention makes it possible to obtain a very precise temperature of the wire at the outlet of the treatment, this temperature not varying by more than 1.5° C. plus or minus from the temperature indicated at the outlet of the tubes 2 in the case of Examples 1 to 8, which makes it possible to guarantee good constancy of the quality of the wire.

Examples 9 to 12 which follow are carried out in a device similar to the device 100 previously described, but these examples are not in accord with the invention. The characteristics of the wire 1 and of this device are given in the following Table 3. These examples are characterized by a $T_c/D_f$ ratio which is substantially greater than 4 seconds per millimeter of diameter of wire, the values of the ratios R and K not corresponding to the whole of the relationships (1) and (2) previously indicated, and the austenitization cannot then be carried out with the advantages previously described.

TABLE 3

| | Example No. | | | |
|---|---|---|---|---|
| | 9 | 10 | 11 | 12 |
| Properties of wire 1 | | | | |
| Carbon content of the steel (% by weight) | 0.70 | 0.85 | 0.75 | 0.80 |
| $D_f$(mm) | 0.53 | 1.75 | 1.75 | 5.50 |
| Properties of the device | | | | |
| Nature of the tube 2 | alumina | alumina | alumina | refractory steel |
| $D_{ti}$ (mm) | 5 | 5 | 3 | 7 |
| $D_{te}$ (mm) | 10 | 10 | 6 | 14 |
| Power of the resistor 6 (kw) | 0.5 | 6 | 9 | 25 |
| Temperature of the outer face 21 of the tube 2 (°C.): | 1100 | 1100 | 1100 | 1100 |
| Speed of travel of the wire 1 (meters per second) | 0.24 | 0.46 | 0.65 | 0.187 |
| Length of the tube 2 (meters) | 2 | 6 | 6 | 5 |
| Heating time $T_c$ (seconds) | 8.3 | 13 | 9.2 | 26.7 |
| Production of the device (kilograms of wire 1/hour) | 1.5 | 31.3 | 44.3 | 12.6 |
| Temperature of the wire 1 at the entrance to the tube 2 (°C.) | 20 | 20 | 20 | 20 |
| Temperature of the wire 1 at the outlet of the tube 2 (°C.) | 980 | 980 | 980 | 980 |
| $\lambda$ (watts · $m^{-1}$ · °$K.^{-1}$) | 0.059 | 0.220 | 0.160 | 0.220 |
| R | 9.43 | 2.86 | 1.71 | 1.27 |
| K | 10.68 | 14.60 | 10.31 | 33.16 |
| Heating time per millimeter of diameter of wire 1 (second/mm) ($T_c/D_f$) | 15.7 | 7.43 | 5.26 | 4.85 |

The nature of the gas 4 was as follows in Examples 9 to 12:

Example 9: pure $N_2$

Example 10: $N_2$=50% $H_2$=50%

Example 11: $N_2$=65% $H_2$=35%

Example 12: $N_2$=50% $H_2$132 50% (% by volume)

In all the examples according to the invention, a homogeneous austenite structure is obtained.

Figure 5:
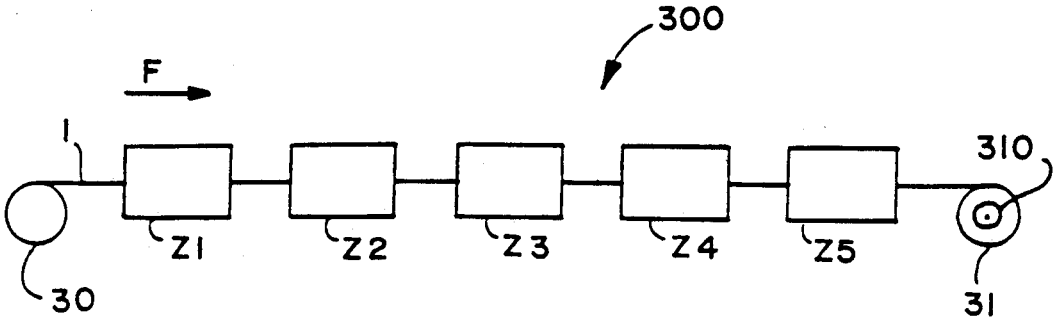

FIG. 5 shows a complete installation for the heat treatment of a carbon steel wire 1 in order to obtain a fine pearlitic structure. This installation 300 comprises the zones $Z_1$, $Z_2$, $Z_3$, $Z_4$, $Z_5$, the wire 1 passing through these zones in the direction indicated by the arrow F from the starting bobbin 30 to the bobbin 31 on which the treated wire 1 is wound. The bobbin 31 is driven in rotation by the motor 310 which therefore imparts travel to the wire 1 in the direction indicated by the arrow F. The wire 1 passes in succession through the zones $Z_1$ to $Z_5$ in that order.

The zone $Z_1$ corresponds to the heating of the wire 1 in order to obtain a homogeneous austenite structure;

the zone $Z_2$ corresponds to the cooling of the wire 1 to a temperature of 500° C. to 600° C. so as to obtain a metastable austenite;

Zone $Z_3$ corresponds to the transformation of metastable austenite into pearlite;

Zone $Z_4$ corresponds to a cooling of the wire 1 after pearlitization to a temperature, for instance, of about 300° C.;

Zone $Z_5$ corresponds to a final cooling of the wire 1 in order to bring it to a temperature close to ambient temperature, for instance, 20° C. to 50° C.

Figure 6:
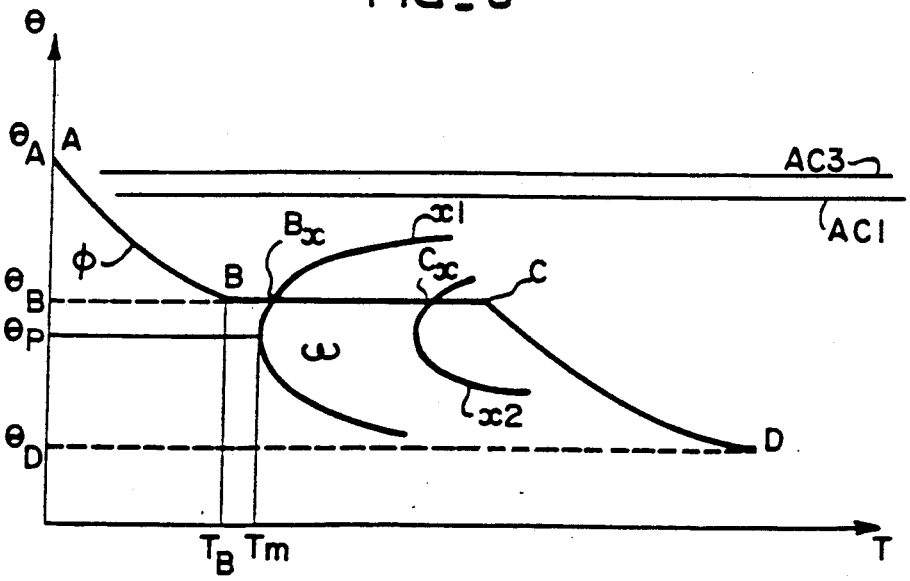

FIG. 6 shows the curve $\phi$ which indicates the change in temperature of the steel wire 1 as a function of time when this wire passes through zones $Z_2$ to $Z_5$. This figure also shows the curve $x_1$ corresponding to the start of the transformation of metastable austenite into pearlite and the curve $x_2$ corresponding to the end of the transformation of metastable austenite into pearlite for the steel of this wire. In this FIG. 6, the abscissa axis corresponds to the time T and the ordinate axis corresponds to the temperature $\theta$, the time origin corresponding to the point A.

Prior to the pearlitization treatment, the wire 1 is heated and maintained at a temperature above the AC3 transformation temperature so as to obtain a homogeneous austenite, this temperature $\theta_A$, which, for instance, is between 900° C. and 1000° C., corresponds to the point A of FIG. 6. The point known as "pearlite nose" corresponds to the minimum time $T_m$ of the curve $x_1$, the temperature of this pearlite nose being indicated as $\theta$p.

The wire 1 is then cooled until it reaches a temperature below the AC1 transformation temperature, the state of the wire after this cooling corresponding to the point B and the temperature obtained at this point B at the end of the time $T_B$ being marked $\theta_B$. This temperature $\theta_B$ has been represented in FIG. 6 as higher than the temperature $\theta_P$ of the pearlite nose, as is most frequent in practice, without being absolutely necessary. During this cooling of the wire between the points A and B there is a transformation of stable austenite into metastable austenite as soon as the temperature of the wire drops below the AC3 transformation point, and "seeds" appear at the grain joints of the metastable austenite. The zone between the curves $x_1$, $x_2$ is marked $\omega$. The pearlitization consists in causing the wire to pass from the state represented by the point B at the left of the zone $\omega$ to a state represented by the point C at the right of the zone $\omega$. This transformation of the wire is diagrammatically indicated, for instance, by the straight line segment BC which intersects the curve $x_1$ at $B_x$ and the curve $x_2$ at $C_x$, but the invention also applies to cases in which the variation in the temperature of the wire between the points B and C is not linear.

The formation of the seeds continues in the part of the segment BC located to the left of the zone $\omega$, that is to say, in the segment $BB_x$. In the part of the segment BC within the zone $\omega$, the segment $B_xC_x$, there is a transformation of metastable austenite into pearlite, that is to say, pearlitization. The pearlitization time is susceptible to variation from one steel to another, therefore the treatment represented by the segment $C_xC$ has the purpose of avoiding the application of premature cooling to the wire in the event that the pearlitization should completed. In fact, residual metastable austenite which would be subjected to rapid cooling would be transformed into bainite, which is not a structure favorable for drawing after heat treatment or for the value in use and the mechanical properties of the final product.

A rapid cooling between the points A and B followed by isothermal holding in the metastable austenite domain, that is to say, between the points B and $B_x$, permits an increase in the number of seeds and a decrease in their size. These seeds are the starting points of the further transformation of the metastable austenite into pearlite and it is well known that the fineness of the pearlite and therefore the utilitarian value of the wire will be greater the more numerous and smaller these seeds are.

After the pearlitization treatment, the wire is cooled, for instance, to ambient temperature; this cooling, which is preferably rapid, is diagrammatically indicated for example by the curved line CD, the temperature D being marked $\theta_D$.

In the installation 300, the zone $Z_1$ corresponds to the heating of the wire 1 in order to bring it to the condition corresponding to point A, the zone $Z_2$ corresponds to the cooling represented by the portion AB of the curve $\phi$, the zone $Z_3$ corresponds to the portion BC of the curve $\theta$, the zones $Z_4$ and $Z_5$ together corresponding to the cooling represented by the portion CD of the curve $\phi$.

The zone $Z_1$ is produced, for example, with the device 100 according to the invention, which has been previously described.

The zone $Z_2$ is produced, for instance, in accordance with French Patent Application No. 88/00904. The device 32 corresponding to this zone $Z_2$ is shown in FIGS. 7 and 8.

This device 32 is a heat exchanger having an enclosure 33 in the form of a tube of inside diameter $D'_{ti}$ and an outside diameter $D'_{te}$ in which the wire 1 to be treated, of diameter $D_f$, passes in the direction indicated by the arrow F.

Figure 7:
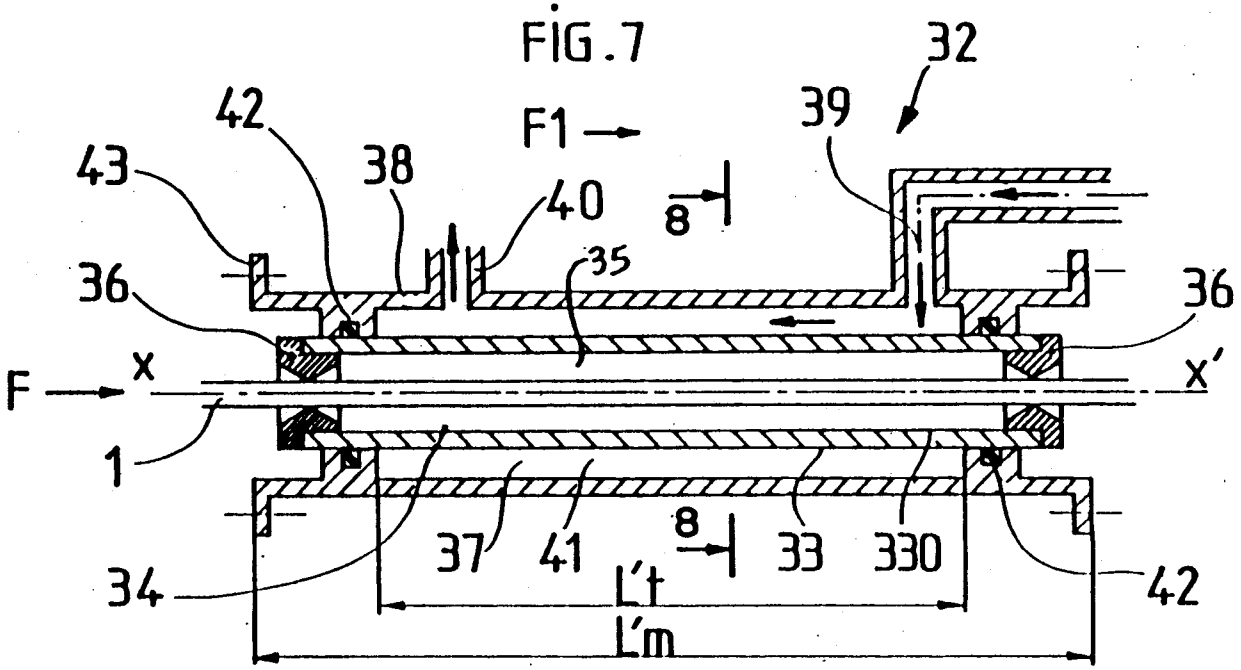
Figure 8:
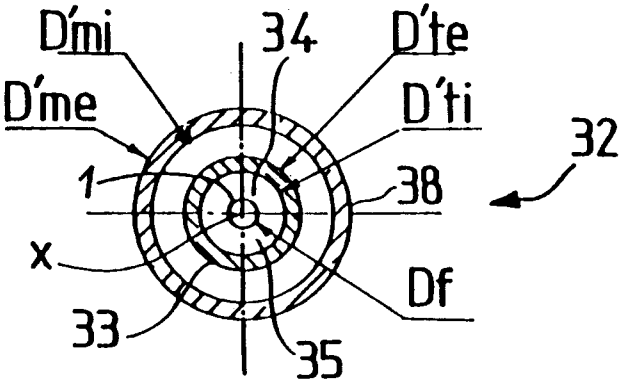

FIG. 7 is a section taken along the axis xx' of the wire 1, which is also the axis of the device 32, and FIG. 8 is a section taken perpendicular to said axis xx', the section of FIG. 8 being diagrammatically indicated by the straight line segments VIII—VIII in FIG. 7, the axis xx' being diagrammatically indicated by the letter "x" in FIG. 8. The space 34 between the wire 1 and the tube 33 is filled with a gas 35 which is in direct contact with the wire 1 and with the inner wall 330 of the tube 33. The gas 35 remains in the space 34 during the treatment of the wire 1, the device 32 being without means capable of permitting forced ventilation of the gas 35, that is to say, the gas 35, which is substantially without forced ventilation, is possibly placed in movement within the space 34 only by the displacement of the wire 1 in the direction indicated by the arrow F. Upon the heat treatment of the wire 1, a transfer of heat takes place from the wire 1 toward the gas 35. $\lambda'$ is the conductivity of the gas 35, determined at 600° C. This conductivity is expressed in watts.m$^{-1}$.°K$^{-1}$. The wire 1 is guided by two wire guides 36 made, for instance, of ceramics or tungsten carbide, these guides 36 being located one at the entrance and the other at the exit of the wire 1 in the tube 33. The tube 33 is cooled on the outside by a heat transport fluid 37, for instance water, flowing in an annular sleeve 38 which surrounds the tube 33. This sleeve 38 has a length $L'_m$, an inside diameter $D'_{mi}$ and an outside diameter $D'_{me}$. The sleeve 38 is fed with water 37 through the connection 39; the water 37 emerges from the sleeve 38 via the connection 40, the flow of the water 37 along the tube 33 thus taking place in the direction opposite the direction F. The seal between the zone 41 containing the water 37 (inside volume of the sleeve 38) and the space 34 containing the gas 35 is obtained by means of joints 42 made, for instance, of elastomers. The length of the tube 33 in contact with the fluid 37 is marked $L'_t$ in FIG. 7.

The exchanger 32 can by itself constitute a device for the zone $Z_2$. One can also assemble several exchangers 32 along the axis xx' by means of the flanges 43 constituting the ends of the sleeve 38, the wire 1 then passing through several exchangers 32 arranged in series along the axis xx'.

The characteristics of the tube 33, the wire 1 and the gas 35 are so selected that the following relationships are satisfied upon the cooling preceding the pearlitization, which is indicated diagrammatically by the part AB of the curve $\phi$:

$$1.05 \leqq R' \leqq 15 \quad (3)$$

$$5 \leqq K' \leqq 10 \quad (4)$$

with, by definition:

$$R' = D'_{ti}/D_f$$

$$K' = [Log\,(D'_{ti}/D_f)] \times D_f^2/\lambda'$$

$D'_{ti}$ and $D_f$ being expressed in millimeters, $\lambda'$ being the conductivity of the gas determined at 600° C. and expressed in watts.m$^{-1}$.°K$^{-1}$, Log being the natural logarithm.

The gas 35 is, for example, hydrogen, nitrogen, helium, a mixture of hydrogen and nitrogen, of hydrogen and methane, of nitrogen and methane, of helium and methane, and of hydrogen, nitrogen and methane.

In the case of wires 1 of large diameter, the ratio R' between the inside diameter $D'_{ti}$ and the diameter $D_f$ of the wire must be close to 1, and the use of a very conductive gas 35, for instance hydrogen, becomes necessary.

The zone $Z_3$ of the installation 300 is developed, for instance, by the use of several exchangers 32 arranged in series under the conditions described below.

In order to obtain a transformation from austenite into pearlite under the best conditions, it is preferable that the transformation steps of the wire 1, indicated diagrammatically by the line BC in FIG. 1, take place at a temperature which varies as little as possible, the temperature of the wire 1, for instance, not differing by more than 10° C. plus or minus from the temperature $\theta_B$ obtained after the cooling indicated diagrammatically by the line AB. This limitation on the variation of the temperature is therefore effected for a period of time greater than the pearlitization time, this pearlitization time corresponding to the segment BxCx. The temperature of the wire 1 advantageously does not differ by more than 5° C. plus or minus from the temperature $\theta_B$ on this line BC. FIG. 6 shows, for instance, the ideal case in which the temperature is constant and equal to $\theta_B$ during diagrammatically indicated by the line BC which is therefore a straight line segment parallel to the abscissa axis.

The transformation of austenite into pearlite which takes place in the region $\omega$ liberates an amount of heat of about 100,000 J.Kg$^{-1}$, with a transformation rate which varies in this region as a function of the time, this speed being low in the vicinity of the points $B_x$ and $C_x$ and maximum toward the middle of the segment $B_x C_x$. Under these conditions, if a practically constant temperature upon this transformation is desired, it is necessary to effect modulated heat exchanges, that is to say, heat exchanges the power of which per unit of length of the wire 1 varies along the device in which this transformation takes place, the cooling due to the gas 35 being maximum when the rate of pearlitization is maximum, so as to avoid the phenomenon of recalescence due to an excessive increase in temperature of the wire 1 upon pearlitization.

This modulation can be effected preferably by varying either the inside diameter $D'_{ti}$ of the tubes 33 through which the wire passes, or the length $L'_t$ of the various tubes 33 through which the wire passes, as described in the aforementioned French Patent Application No. 88/00904.

In the zone $Z_3$, the exchanger 32, the cooling power of which is the greatest, corresponds to the region where the rate of pearlitization is the highest. Under these conditions:

if the modulation is effected by varying the inside diameter $D'_{ti}$ of the tubes 33, this diameter decreases from the entrance of the zone $Z_3$ up to the exchanger 32 where the speed of pearlitization is the highest, whereupon this diameter then increases in the direction toward the outlet of the zone $Z_3$, in the direction indicated by the arrow F;

if modulation is effected by varying the length $L'_t$ of the tubes 33, this length increases from the entrance of the zone $Z_3$ up to the exchanger 32 where the rate of pearlitization is the greatest, and then this length decreases in the direction toward the outlet of the zone $Z_3$ in the direction of the arrow F.

In both cases there is produced, in the direction of the arrow F, an increase in the cooling power from the entrance of the zone $Z_3$ up to the exchanger 32 where the rate of pearlitization is the fastest, and then this power decreases in the direction toward the outlet of the zone $Z_3$.

In this exchanger 32 in which the rate of pearlitization is the fastest, the following relationships preferably apply:

$$1.05 \leqq R' \leqq 8 \quad (5)$$

$$3 \leqq K' \leqq 8 \quad (6)$$

R' and K' having the same meanings as previously.

The zone $Z_4$ is formed, for instance, by an exchanger 32 which satisfies the relations (3) and (4) previously defined.

The wire 1 then penetrates into the zone $Z_5$ where it is brought to a temperature approaching ambient temperature, for instance, 20° to 50° C., by immersion in water.

Figure 9:
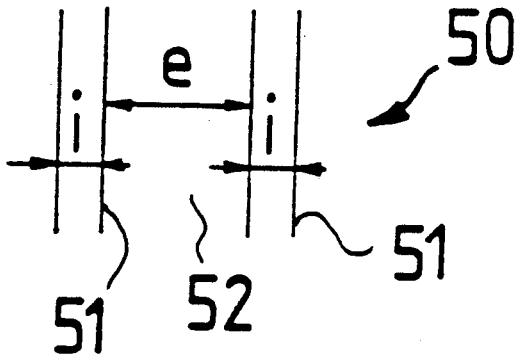

The wire 1 treated in the installation 300 has the same structure as that obtained by the known patenting method with lead, that is to say, a fine pearlitic structure. This structure comprises lamellae of cementite separated by lamellae of ferrite. By way of example, FIG. 9 shows, in cross-section, a portion 50 of such a fine pearlitic structure. This portion 50 has two cementite lamellae 51 which are practically parallel to each other, separated by a ferrite lamellae 52. The thickness of the cementite lamellae 51 is represented by "i" and the thickness of the ferrite lamellae 52 is represented by "e". The pearlitic structure is fine, that is to say, the average value i+e is at most equal to 1000 Å, with a standard deviation of 250 Å.

Such a wire can serve, for instance, to reinforce articles of plastic or rubber, in particular, tires.

The installation 300 makes it possible furthermore to obtain at least one of the following results:

After heat treatment and before drawing, the wire has an ultimate tensile strength at least equal to 1300 MPa;

The wire can be drawn in such a manner as to have a ratio of the sections at least equal to 40;

After drawing, the wire has an ultimate tensile strength at least equal to 3000 MPa.

The ratio of the sections corresponds by definition to the ratio:

$$\frac{\text{cross-section of the wire before drawing}}{\text{cross-section of the wire after drawing}}$$

The installation 300 has the following advantages:

simplicity, low investment and operating expenses, since:

the use of molten salts or metals is avoided;

the use of compressors or turbines which would be necessary with a forced gas circulation is avoided;

a precise law of cooling can be obtained and the phenomenon of recalescence can be avoided;

possibility of carrying out with the same installation a pearlitization treatment on wire diameters $D_f$ which may vary within wide limits;

any problem of hygiene is avoided and cleaning of the wire is not necessary since one avoids the use of molten salts or metals.

These advantages are obtained only when relationships (3) and (4) are satisfied upon the cooling indicated by the portion AB of the curve $\phi$ (FIG. 6). When tubes containing a gas without forced ventilation are used, the tube being surrounded by a heat transport fluid, but when relationships (3) and (4) are not satisfied upon the cooling preceding the pearlitization corresponding to the portion AB of the curve $\phi$, it is not possible to effect a correct pearlitization.

The invention is not limited to the embodiments which have been described above.

I claim:

1. A method for heat treating at least one carbon steel wire so as to obtain a homogeneous austenite structure, comprising the following steps:

a) heating the wire by passing it through at least one tube containing a gas which is substantially without forced ventilation, the gas being in direct contact with the wire, the time of heating of the wire being less than 4 seconds per millimeter of the diameter of the wire;

b) selecting the tube, the wire and the gas so that the following relationships are satisfied:

$$1.05 \leqq R \leqq 7 \quad (1)$$

$$0.6 \leqq K \leqq 8 \quad (2)$$

with, by definition $$R = D_{ti}/D_f$$

$$K = [Log\ (D_{ti}/D_f)] \times D_f^{2\lambda}$$

$D_{ti}$ being the inside diameter of the tube expressed in millimeters, $D_f$ being the diameter of the wire expressed in millimeters, λ being the conductivity of the gas determined at 800° C., this conductivity being expressed in watts.m$^{-1}$.°k$^{-1}$, Log being the natural logarithm.

2. A method according to claim 1, wherein the tube is subjected to heating externally by an electric resistor.

3. A method according to claim 1, wherein the gas is in thermodynamic equilibrium with the carbon of the steel of the wire.

4. A method according to claim 1, wherein the gas permits a superficial recarburizing of the steel wire.

5. A method according to claim 1, wherein the gas exerts a deoxidizing action on the surface of the wire.

6. A method according to claim 1, wherein the wire is subjected to pearlitizating.

7. A method according to claim 6, including:

c) cooling the wire from a temperature above the AC3 transformation temperature to a temperature below the AC1 transformation temperature;

d) carrying out the pearlitization treatment at a temperature below the AC1 transformation temperature;

e) this cooling and pearlitization treatment being carried out by passing the wire through at least one tube containing a gas which is substantially without forced ventilation, the tube being surrounded by a heat transport fluid in such a manner that a transfer of heat takes place from the wire, through the gas and the tube, toward the heat transport fluid;

f) selecting the tube, the wire and the gas are so selected that the following relationships are satisfied at least upon the cooling preceding the pearlitization:

$$1.05 \leqq R' \leqq 15 \quad (3)$$

$$5 \leqq K' \leqq 10 \quad (4)$$

with, by definition, $$R' = D'_{ti}/f$$

$$K' = [Log(D'_{ti}/D_f)] \times D_f^2/\lambda$$

$D'_{ti}$ being the inside diameter of the tube expressed in millimeters, $D_f$ being the diameter of the wire expressed in millimeters, λ' being the conductivity of the gas determined at 600° C., this conductivity being expressed in watts.m$^{-1}$.°K$^{-1}$, Log being the natural logarithm.

8. A method according to claim 7, including after having cooled the wire from a temperature above the AC3 transformation temperature to a given temperature below the ACl transformation temperature, the step of maintaining the wire at a temperature which does not differ by more than 10° C. plus or minus from said given temperature for a period of time greater than the pearlitization time by modulating the heat exchanges, the following relationships being satisfied in the zone or zones of the tube or tubes where the rate of pearlitization is the fastest:

$$1.05 \leqq R' \leqq 8 \quad (5)$$

$$3 \leqq K' \leqq 8 \quad (6)$$

9. A method according to claim 8, wherein the wire is maintained at a temperature which does not vary by more than 5° C. plus or minus from said given temperature.

10. A method according to claim 8, wherein the modulation is effected by varying the inside diameter of the tube, or of at least one tube.

11. A method according to claim 8, wherein the modulation is effected by using several tubes of varying length.

12. A method according to claim 6, wherein the wire is then subjected to cooling.

13. A device for heat treating at least one carbon steel wire so as to obtain a homogeneous austenite structure, wherein the device has the following features:

a) it comprises at least one tube and means for passing the wire through the tube; the tube contains a gas which is substantially without forced ventilation in direct contact with the wire; it further comprises means for heating the gas; the means for passing the wire through the tube are such that the time of contact of the wire with the gas is less than 4 seconds per millimeter of diameter of the wire;

b) wherein the tube, the wire and the gas are so selected that the following relationships are satisfied:

$$1.05 \leqq R \leqq 7 \quad (1)$$

$$0.6 \leqq K \leqq 8 \quad (2)$$

with, by definition, $$R = D_{ti}/D_f$$

$$K = [Log(D_{ti}/D_f)] \times D_f^2/\lambda$$

$D_{ti}$ being the inside diameter of the tube expressed in millimeters, $D_f$ being the diameter of the wire expressed in millimeters, λ being the conductivity of the gas determined at 800° C., this conductivity being expressed in watts.m$^{-1}$,°k$^{-1}$, Log being the natural logarithm.

14. A device according to claim 13, wherein it comprises an electric resistor arranged on the outside of the tube in order to heat it.

15. A device according to claim 13, wherein it comprises an enclosure within which several tubes are arranged.

16. A device according to claim 13, wherein the diameter $D_f$ of the wire varies from 0.4 to 6 mm.

17. A device according to claim 13, wherein it makes it possible to treat wires within a diameter ratio $D_f$ of 1 to 5.

18. An installation for the heat treatment of at least one carbon-steel wire comprising at least one device according to claim 13.

19. A heat treatment installation according to claim 18, wherein behind the austenitization device it comprises means for cooling the wire and to obtain a fine pearlitic structure, these means being defined by the following features:

c) the cooling and pearlitization means comprise at least one tube containing a gas which is substantially without forced ventilation, this tube being surrounded by a heat transport fluid in such a manner that a transfer of heat takes place from the wire through the gas and the tube toward the heat exchange fluid;

d) the tube, the wire and the gas are so selected that the following relationships are satisfied at least upon the cooling which precedes the pearlitization:

$$1.05 \leqq R' \leqq 15 \quad (3)$$

$$5 \leqq K' \leqq 10 \quad (4)$$

with, by definition, $$R' = D'_{ti}/D_f$$

$$K' = [Log(D'_{ti}/D_f)] \times D_f^2/\lambda'$$

$D'_{ti}$ being the inside diameter of the tube expressed in millimeters, $D_f$ being the diameter of the wire expressed in millimeters, $\lambda'$ being the conductivity of the gas determined at 600° C., this conductivity being expressed in watts.$m^{-1}$.°$K^{-1}$, Log being the natural logarithm.

20. An installation according to claim 19, wherein one or more tubes are arranged in such a manner that after the cooling of the wire from a temperature above the AC3 transformation temperature to a given temperature below the ACl transformation temperature, they make it possible to maintain the wire at a temperature which does not differ by more than 10° C. plus or minus from said given temperature, for a period of time greater than the pearlitization time, by modulating the thermal exchanges, the following relationships being satisfied in the zone or zones of the tube or tubes where the rate of pearlitization is the fastest:

$$1.05 \leqq R' \leqq 8 \quad (5)$$

$$3 \leqq K' \leqq 8 \quad (6).$$

21. An installation according to claim 20, wherein that said tube or tubes are so arranged that the temperature of the wire does not differ by more than 5° C. plus or minus from said given temperature.

22. An installation according to claim 20, wherein the inside diameter of the tube or at least of one tube varies in the pearlitization means.

23. An installation according to claim 20, wherein it comprises several tubes, the lengths of which vary in the pearlitization means.

24. An installation according to claim 18, wherein it comprises means for cooling the wire after pearlitization.

* * * * *

UNITED STATES PATENT AND TRADEMARK OFFICE

CERTIFICATE OF CORRECTION

PATENT NO. : 5,032,191

DATED : July 16, 1991

INVENTOR(S) : Andre Reiniche

It is certified that error appears in the above-identified patent and that said Letters Patent is hereby corrected as shown below:

Col. 7, line 55, "$H_2$132" should read --$H_2$ = --.

Col. 8, line 66, "should" should read --should not be--.

Col. 10, line 62, "during" should read --during the steps--.

Col. 13, line 17, "is subjected" should read --is then subjected--.

Col. 13, lines 31-32, "are so selected" should read --so--.

Signed and Sealed this

Second Day of February, 1993

*Attest:*

STEPHEN G. KUNIN

*Attesting Officer*

*Acting Commissioner of Patents and Trademarks*